US009630185B1

(12) United States Patent
Riskin

(10) Patent No.: US 9,630,185 B1
(45) Date of Patent: Apr. 25, 2017

(54) METHOD AND DEVICE FOR CLEANING OF IONIZING ELECTRODES

(71) Applicant: Yefim Riskin, Katzrin (IL)

(72) Inventor: Yefim Riskin, Katzrin (IL)

( * ) Notice: Subject to any disclaimer, the term of this patent is extended or adjusted under 35 U.S.C. 154(b) by 2 days.

(21) Appl. No.: 14/976,374

(22) Filed: Dec. 21, 2015

(51) Int. Cl.

| | |
|---|---|
| ***B03C 3/74*** | (2006.01) |
| ***B03C 3/80*** | (2006.01) |
| ***H01T 21/04*** | (2006.01) |
| ***B08B 1/00*** | (2006.01) |
| *H01T 19/04* | (2006.01) |

(52) U.S. Cl.
CPC ..... *B03C 3/743* (2013.01); *B03C 3/80* (2013.01); *B08B 1/001* (2013.01); *H01T 19/04* (2013.01); *H01T 21/04* (2013.01)

(58) Field of Classification Search
CPC ..... H01T 19/04; H01T 23/00; B03C 3/743; B03C 3/80; B08B 1/001; B08B 1/005; B08B 1/006
See application file for complete search history.

(56) References Cited

U.S. PATENT DOCUMENTS

| | | | | |
|---|---|---|---|---|
| 8,106,367 | B2 | 1/2012 | Riskin | |
| 8,957,571 | B2 | 2/2015 | Riskin | |
| 2015/0236484 | A1* | 8/2015 | Chen | H01T 23/00 361/231 |
| 2015/0336109 | A1* | 11/2015 | Gefter | B03C 3/743 95/2 |

FOREIGN PATENT DOCUMENTS

| | | |
|---|---|---|
| WO | 2012176099 | 12/2012 |

* cited by examiner

*Primary Examiner* — Michael Kornakov
*Assistant Examiner* — Natasha Campbell
(74) *Attorney, Agent, or Firm* — Niels Haun; Dann, Dorfman, Herrell and Skillman, P.C.

(57) ABSTRACT

A device for cleaning ionizing electrodes includes a coil spring fixedly mounted at opposite ends, and an ionizing electrode operable by an actuator plunger for reciprocating movement relative to an axis of the coil spring along a line that extends from an outer periphery of the spring toward an inner periphery thereof, whereby during each reciprocating movement a tip of the electrode penetrates a complete cross-section of the coil spring so as to intersect the adjacent coils at opposing extremities thereof each of which is thereby able to collect dust and other waste deposits from the electrode.

17 Claims, 3 Drawing Sheets

METHOD AND DEVICE FOR CLEANING OF IONIZING ELECTRODES

FIELD OF THE INVENTION

The present invention relates to the methods and the devices for cleaning of ion ionizing electrodes and it is applicable to home appliances and also in industry.

BACKGROUND OF THE INVENTION

Technical solutions are known for cleaning electrodes from dust where the cleaning device travels during cleaning relative to a fixed ionizing electrode or a group of electrodes (e.g. see WO 2012/176099 and U.S. Pat. No. 8,106,367).

The cleaning device disclosed in WO/2012/176099 is formed either as a layer of porous fiber material or a layer of fine-dispersed balls arranged between two grids with cells whose size is bigger than the diameter of the ionizing electrode. At the same time the entire device is designed as a nonstandard solenoid where the permanent magnet and the cleaning device mount are shifted with respect to the fixed coil.

One disadvantage of such a device is the impossibility to use conventional solenoids which increases the complexity of the device.

Another disadvantage is the complicated procedure of selection of the thickness of the porous fiber material or of the diameter of the fine-dispersed balls and also the grids for different diameters of ionizing electrode.

U.S. Pat. No. 8,106,367 discloses an ionizer wherein a fixed array of planar electrodes is wiped between adjacent coils of a spring fixed to a manual slider which functions as a cleaning element. The spring axis is parallel to a line normal to the plane of the electrodes, which are cleaned as the spring is moved manually toward the electrodes while maintaining a constant distance between the spring axis and the line normal to the plane of the electrodes. Such a device cannot be used with a standard ionizing electrode whose tip diameter is much smaller than the diameter of the shank of the electrode.

U.S. Pat. No. 8,957,571 discloses an ionizing electrode with a cleaning mechanism wherein the cleaning mechanism is formed as a fixed tube with the ionizing electrode connected to the solenoid core travelling inside it.

A drawback of the device is the impossibility to use it for ionizing electrodes with needle-type ionizing edges or for ionizing electrodes made of materials such as tungsten or brittle materials such as silicon.

A problematic issue common to all the known devices is the removal of debris from the local cleaning spot.

SUMMARY OF THE INVENTION

An object of the present invention is to reduce or eliminate the drawbacks of the known devices and to provide a simpler device that is effective over the complete active length of the electrode.

This object is realized in accordance with the invention by a method and device for cleaning an ionizing electrode having the features of the respective independent claims.

The essence of the proposed invention is to use a spring most of whose coils having at least two degrees of freedom as a cleaning device adaptable to the changing flexion of the ionizing edge of a needle-shaped electrode placed between the spring coils.

When in the initial position the ionizing edge of the electrode protrudes from the upper spring board.

Cleaning of the ionizing edge of the electrode is performed during reciprocating motion of the electrode in a direction non-parallel to the longitudinal axis of the spring. As a result the ionizing edge of the electrode gets inside the spring or beyond its lower border and then returns to its initial position.

In needle-type electrodes, the diameter of the needle point is several times smaller than the diameter of the body of the electrode. Therefore in a proposed method and device according to the invention, for better adaptation of the spring, the default distance between the adjacent coils prior to penetration by the electrode tip is set smaller than the needle point diameter and the number of coils is determined from the equation below:

$$Q > \frac{d_{max}}{l}$$

where:

Q—is the number of coils, $d_{max}$—is the maximal electrode diameter, l—is the distance between the adjacent coils.

To explain this formula conceptually, it will be appreciated that as the electrode penetrates adjacent coils of the spring, the coils are displaced and are pushed against the remaining coils of the spring which are thereby compressed. There must therefore be a sufficient number of coils in the spring such that their cumulative displacement equals or exceeds the diameter of the electrode.

In order to enable the use of the same spring for electrodes of different diameters, the distance between the adjacent coils can be controlled by adjusting the degree of spring compression.

In the proposed method and device the spring has an additional function to provide galvanic coupling between the electrodes and the high voltage terminal.

The ionizing electrode is formed as a thin-walled tube which enables part of the waste to be discharged through the cavity in the inner electrode during cleaning.

In some embodiments compressed air is forced into the inner cavity of the electrode during cleaning, thereby significantly improving the process of the electrode cleaning and also more effectively removing waste from the cleaning element.

A device according to the invention comprises the following parts: a body with a coil spring mounted inside it with ionizing electrode mounted between the coils of the spring, an actuator with power supply terminals and a plunger, with its edge being connected with the non-ionizing edge of the electrode, as well as electrically interconnected contact element and a high voltage supply terminal of the device.

In some embodiments the plunger has an air channel which is connected to the inner cavity of the electrode.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF THE INVENTION

In the following description of some embodiments, identical components that appear in more than one figure or that share similar functionality will be referenced by identical reference symbols.

Figure 1:
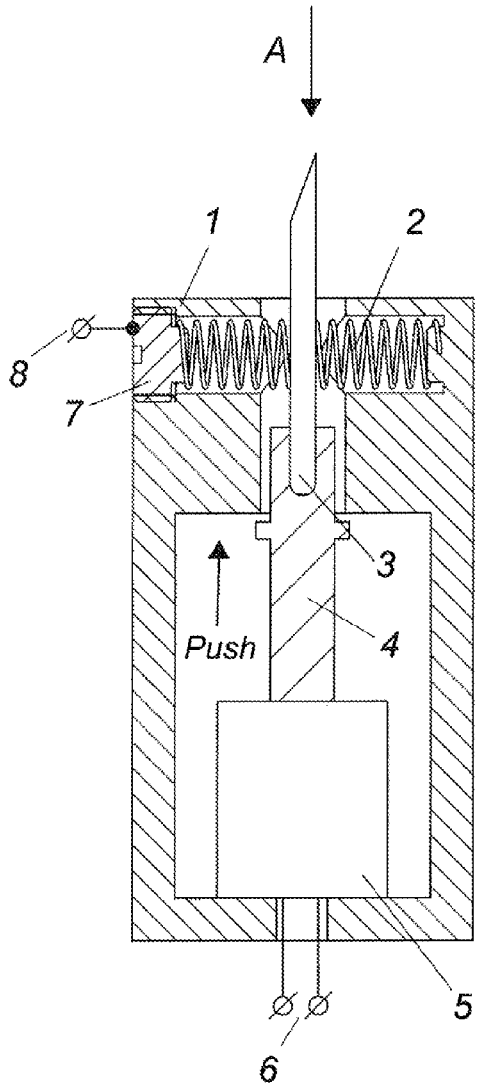
FIG. 1 is a schematic diagram of a first embodiment of the device set to the "Ionizing" mode.

FIG. 1 is a schematic diagram of the electrodes cleaning device according to a first embodiment of the invention set to the "Ionizing" mode. The device comprises the following elements: a body 1, a coil spring 2 formed of an electrically conducting material, an ionizing electrode 3 adapted for axial movement in a cavity of the body, a plunger 4 made of an insulating material which constitutes a part of an actuator 5, power supply terminals 6 of the actuator 5, a contact element 7 formed of an electrically conducting material, and a high voltage supply terminal 8. The contact element 7 both supports one end of the coil spring 2 and allows high voltage to be fed thereto via the supply terminal 8. In a "PUSH" or "Ionizing" mode of operation, the actuator 5 is adapted to push the plunger 4 so as to force the ionizing electrode 3 out of the body cavity thereby laterally displacing the spring coils. Alternatively, when operated in a "PULL" or "Cleaning" mode, the plunger 4 retracts the ionizing electrode 3 into the body cavity. The coil spring 2 is fastened between the body 1 and the contact element 7 thus providing to the spring at least two degrees of freedom of motion along most of its length. Specifically, although restrained at its two ends, the spring axis is free to move in any direction normal to the axis and the coils are able to be displaced axially toward and away from each other. When the actuator in set to the "PUSH" mode, the tip of the ionizing electrode 3 protrudes completely through the spring 2 and allows it to ionize the air.

Figure 2:
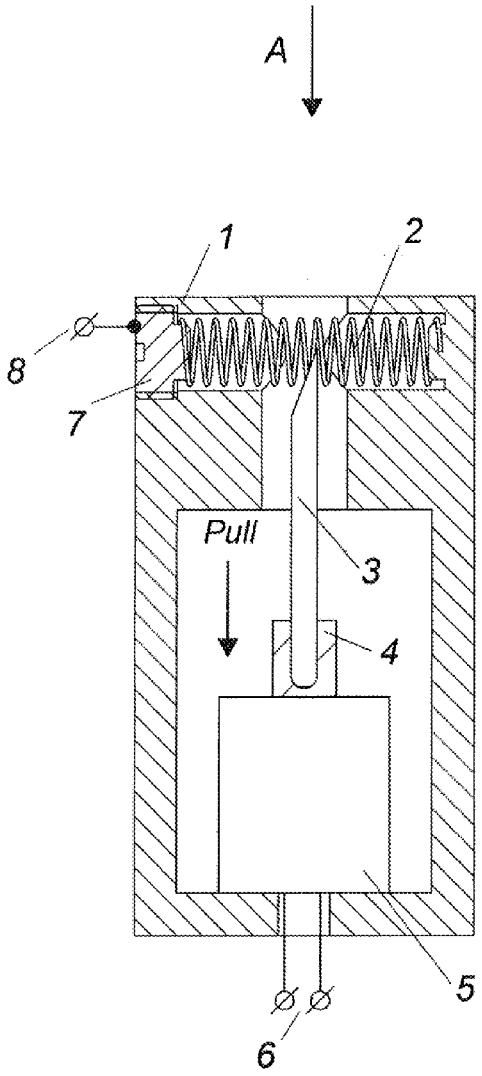
FIG. 2 is a schematic diagram of the device shown in FIG. 1 set to the "cleaning" mode.

FIG. 2 is a schematic diagram of the device set to "cleaning" mode showing that most of the shank of the electrode 3 is withdrawn from the boundary of the coil spring 2, with only the tip of the electrode 3 abutting a lower side surface of one of the coils. In practice, in "PULL" or "Cleaning" mode, the plunger 4 retracts the ionizing electrode 3 and then pushes it out again so as to subject the electrode to reciprocating movement, whereby its tips engages the coil at its upper end and at its lower end during each pass. So, the electrode 3 is swiped twice by the coil spring 2 for each reciprocating pull-push movement.

Figure 3A:
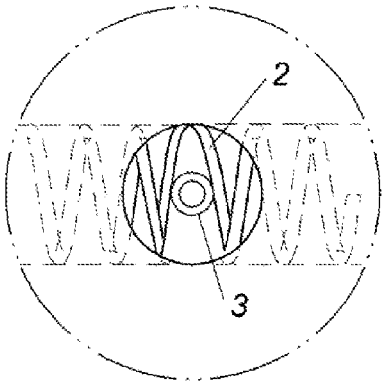
FIGS. 3*a* and 3*b* are enlarged details showing operation of the device.
Figure 3B:
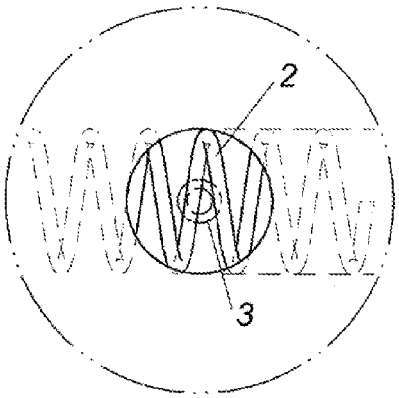

FIGS. 3*a* and 3*b* are plan views seen in the direction of arrow "A" in FIGS. 1 and 2, illustrating the interaction of the electrode 3 with the spring 2 in "PUSH" and "PULL" modes, respectively.

Figure 3C:
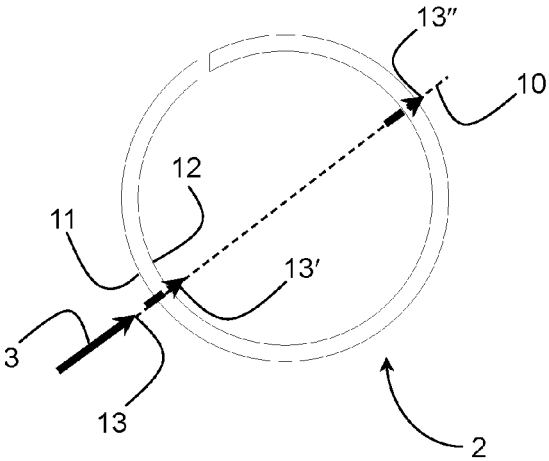
FIG. 3*c* is a schematic cross-section through a spring of the device showing movement of the electrode in "cleaning" mode.

FIG. 3*c* is a schematic cross-section through the spring 2 showing movement of the electrode 3 in "cleaning" mode. The electrode 3 moves along an imaginary line 10 that extends from an outer periphery 11 of the spring, constituting an extremity thereof toward an inner periphery 12 thereof. During each reciprocating movement, a tip 13 of the electrode penetrates the coil spring at at least one extremity thereof so as to at least partially intersect adjacent coils at the at least one extremity as shown in broken line by the tip 13', which thereby collect dust and other waste deposits from the electrode. Optionally, the electrode 3 passes through the complete cross-section and emerges from an opposite extremity as shown in broken line by the tip 13".

Figure 4:
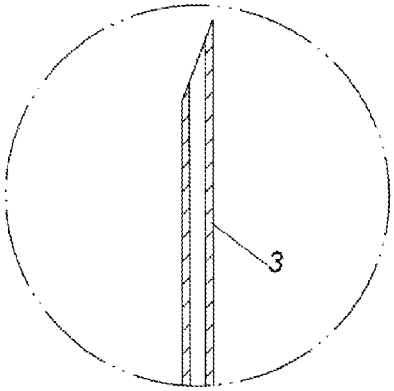
FIG. 4 shows pictorially a cross-section of the tip of the ionizing electrode.

FIG. 4 shows pictorially a cross-section of the tip of the ionizing electrode 3.

The device operates as follows. In "PUSH" or "Ionizing" mode, the ionizing electrode 3 is pushed out through adjacent coils of the spring so as to project out of the body 1 of the device. High voltage fed to the terminal 8 is applied to the ionizing electrode 3 via the contact element 7 and the coil spring 2 both of which are electrically conductive. When this occurs, air in the vicinity of the tip of the ionizing electrode is ionized. During ionization of the air, adjacent coil springs are laterally displaced by the shank of the electrode and the resulting spring force ensures that good electrical contact is maintained between the spring and the electrode, whereby high voltage is continually applied to the electrode.

In "PULL" or "Cleaning" mode the actuator 5 retracts the plunger 4 and the electrode 3 attached thereto, thereby swiping the outer surface of the electrode 3 between adjacent coils of the spring 2 under the compressive force of these coils. During the retraction of the electrode, the adjacent coils of the spring thereby apply mechanical contact to the outer surface of the electrode 3 such that any debris or waste formed on its outer surface is removed by the spring 2. The spring 2 therefore serves a dual function in that it both applies high voltage to the ionizing electrode 3 and also wipes away surface debris that accumulates on its outer surface.

It should also be noted that during each reciprocating movement of the electrode, the tip of the electrode penetrates a complete cross-section of the coil spring 2 so as to intersect the adjacent coils at opposing extremities thereof each of which is thereby able to collect dust and other waste deposits from the electrode. This is distinct from above-mentioned U.S. Pat. No. 8,106,367 where, during manual swiping of the coil spring, the tip of the planar electrodes intersects adjacent coils of the spring on only one extremity thereof.

The ionizing electrode 3 may be formed of a solid material with a tip having a smaller diameter than its shank since also in this case the movement of the electrode will wipe surface debris off the electrode. However, there are advantages in forming the electrode 3 as a thin-walled tube. First, dust and other debris removed from the surface of the electrode may then be discharged through the hollow bore rather than accumulate on the surface of the spring coils. Secondly, the device is more easily adapted for use in both domestic and industrial applications, since the thin-walled tube can be used as an electrode support made either of such non-rigid materials as tungsten or such brittle materials as silicon. Tungsten has a very high melting point but is relatively soft and therefore not so easily capable of laterally displacing the spring coils. However, this disability is compensated for by its being supported inside a thin-walled rigid tube. Likewise, electrodes formed of brittle materials such as silicon can be supported inside a thin-walled rigid tube.

Preferably, the contact element 7 has an external thread for threadably engaging an internal screw thread in the housing. This allows the contact element 7 to be screwed into and out of the housing thereby adjusting the compression of the spring 2. Consequently, unlike known devices in which the entire cleaning element must be replaced whenever the diameter of the ionizing elements is changed, in the device according to the invention this is not required since the contact element 7 permits the distance between the spring coils to be easily adjusted by changing the degree of compression of the spring 2.

Figure 5:
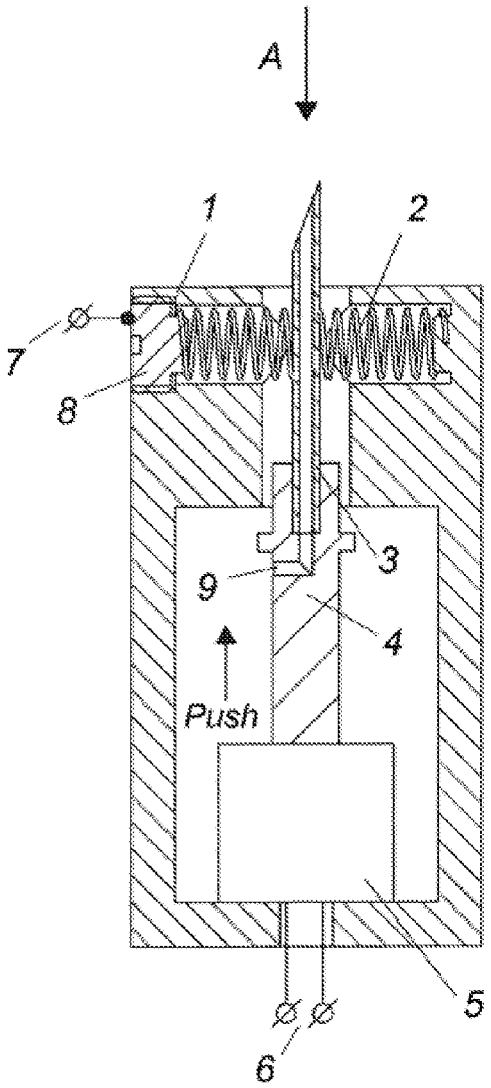
FIG. 5 is a schematic diagram of a second embodiment of the device set to the "Ionizing" mode.
Figure 6:
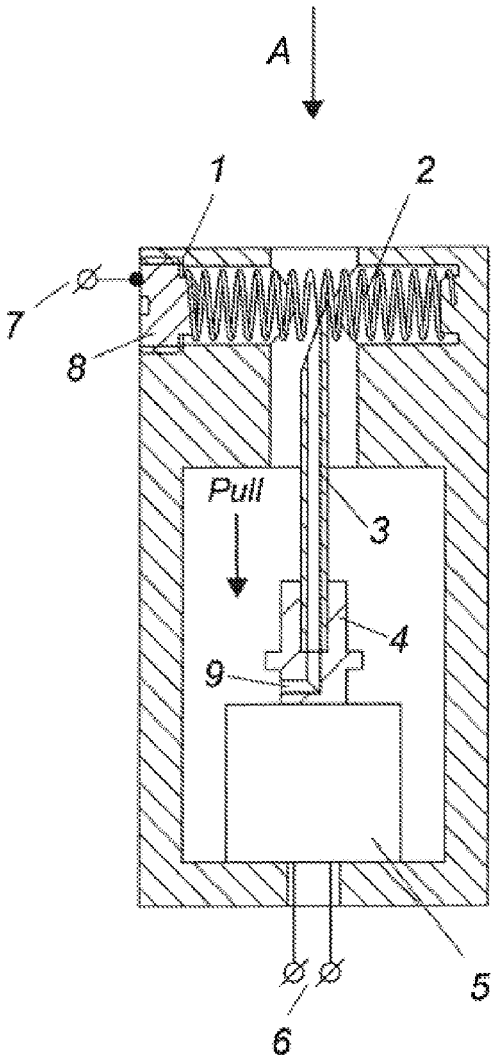
FIG. 6 is a schematic diagram of the device shown in FIG. 5 set to the "cleaning" mode.

Reference is now made to FIGS. 5 and 6 showing a second embodiment of the device set respectively to the "Ionizing" mode and the "cleaning" mode. The description of features of the second embodiment that are identical to those of the first embodiment will not be repeated. The main distinction between the first and second embodiments is the manner in which the hollow cavity inside the electrode 3 is cleared of waste. Thus, while this is done passively in the first embodiment as described above with reference to FIGS. 1 and 2, in the second embodiment shown in FIGS. 5 and 6 it is done actively. To this end, the device includes a channel 9 for feeding compressed air to the plunger 4 at least during the cleaning mode and optionally also during the ionizing mode. The compressed air is thereby supplied via the channel 9 to the hollow cavity of the electrode 3, thereby removing cleaning waste from the inner cavity of the electrode 3 and the surfaces of the spring 2.

In both embodiments as described and illustrated in the figures, the electrode is disposed in a direction that is normal to the longitudinal axis of the spring thereby entering the spring at one extremity and exiting from an opposite extremity through the same coils. But this is not a requirement and the electrode may be oriented at any angle to the longitudinal axis of the spring that allows the tip of the electrode to engage between two adjacent coils and displace them apart in order to penetrate the coils. In such case, different pairs of adjacent coils will be displaced by the electrode on entry and exit, but both pairs of adjacent coils on entry and exit will nevertheless wipe against the electrode and remove dust and other accumulated debris.

It should also be noted that during cleaning mode, the distance between the spring axis and the electrode tip constantly changes as the electrode penetrates the cross-section of the coil, thereby intersecting the coils at opposite extremities. This, too, is distinct from above-mentioned U.S. Pat. No. 8,106,367 where as noted above separation between the normal axis of the electrodes and the spring axis remains constant.

The simplicity of the proposed device is achieved on account of the three elements mounted inside the body 1 each performing two functions as follows:

1. The spring 2:
a. Cleans the electrode;
b. Provides a galvanic coupling between the electrode and the high voltage supply terminal.
2. The contact element 7:
a. Provides an electric contact between the high voltage supply terminal and the spring; and
b. Adjusts the distance between the spring coils.
3. Thin-wall tube shaped ionizing electrode 3 facilitates:
a. Air ionization; and
b. Waste removal via the tube cavity.

It should be noted that features that are described with reference to one or more embodiments are described by way of example rather than by way of limitation to those embodiments. Thus, unless stated otherwise or unless particular combinations are clearly inadmissible, optional features that are described with reference to only some embodiments are assumed to be likewise applicable to all other embodiments also.

The invention claimed is:

1. A method for cleaning an ionizing electrode, the method comprising:

reciprocally swiping the electrode between adjacent coils of a fixed coil spring so as to effect at least one reciprocating movement of the electrode relative to an axis of the coil spring along a line that extends from an outer periphery of the spring toward an inner periphery thereof, during each of which reciprocating movements a tip of the electrode penetrates the coil spring at at least one extremity thereof so as to at least partially intersect adjacent coils at the at least one extremity and thereby collect dust and other waste deposits from the electrode.

2. The method according to claim 1, wherein the spring is fixed at opposite ends so that its axis has at least two degrees of freedom.

3. The method according to claim 1, wherein the adjacent spring coils are displaced by a default distance that is smaller than a diameter of the tip of the electrode, and the number of coils is determined by:

$$Q > \frac{d_{max}}{l}$$

where:
Q—is a number of coils,
$d_{max}$—is a maximal electrode diameter, and
l—is the distance between the adjacent coils.

4. The method according to claim 1, wherein the spring serves as a galvanic coupling between a high voltage supply terminal and the electrode.

5. The method according to claim 1, including configuring the spring for adjustable spring compression in order to change a default distance between the adjacent coils to accommodate electrodes of different diameters.

6. The method according to claim 1, including discharging waste through an internal cavity of the electrode.

7. The method according to claim 6, further including feeding compressed air into the internal electrode cavity.

8. The method according to claim 1, wherein during each reciprocating movement the tip of the electrode penetrates a complete cross-section of the coil spring so as to intersect adjacent coils at opposing extremities thereof each of which is thereby able to collect dust and other waste deposits from the electrode.

9. A device for cleaning ionizing electrodes, the device comprising:

a coil spring fixedly mounted at opposite ends, an ionizing electrode mounted for reciprocating movement relative to an axis of the coil spring, and an actuator plunger configured for engaging the ionizing electrode and operable for inducing the reciprocating movement thereof along a line that extends from an outer periphery of the spring toward an inner periphery thereof, whereby during each reciprocating movement a tip of the electrode penetrates the coil spring at at least one extremity thereof so as to at least partially intersect adjacent coils at the at least one extremity and thereby collect dust and other waste deposits from the electrode.

10. The device according to claim 9, wherein the spring is fixed at opposite ends so that its axis has at least two degrees of freedom.

11. The device according to claim 9, wherein the adjacent spring coils are displaced by a default distance that is smaller than a diameter of the tip of the electrode, and the number of coils is determined by:

$$Q > \frac{d_{max}}{l}$$

where:

Q—is a number of coils, $d_{max}$—is a maximal electrode diameter, and l—is the distance between the adjacent coils.

12. The device according to claim 9, wherein the spring serves as a galvanic coupling between a high voltage supply terminal of an ionizer and the electrode.

13. The device according to claim 9, further including an adjustable contact element for adjusting spring compression in order to change a default distance between the adjacent coils to accommodate electrodes of different diameters.

14. The device according to claim 9, wherein the ionizing electrode is formed as a thin-walled tube having an internal cavity.

15. The device according to claim 14, wherein the actuator plunger has an air channel configured for fluid communication with the internal cavity when the electrode is attached to the actuator plunger, for feeding compressed air via said channel to the internal cavity of the electrode.

16. The device according to claim 9, wherein the ionizing electrode is supported in an end of a thin-walled tube having an internal cavity.

17. The device according to claim 9, wherein the plunger is configured such that during each reciprocating movement the tip of the electrode penetrates a complete cross-section of the coil spring so as to intersect adjacent coils at opposing extremities thereof each of which is thereby able to collect dust and other waste deposits from the electrode.

* * * * *